US012140368B2

(12) United States Patent
Suh

(10) Patent No.: US 12,140,368 B2
(45) Date of Patent: Nov. 12, 2024

(54) REFRIGERATOR

(71) Applicant: Samsung Electronics Co., Ltd., Suwon-si (KR)

(72) Inventor: Junwoo Suh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 221 days.

(21) Appl. No.: 17/168,354

(22) Filed: Feb. 5, 2021

(65) Prior Publication Data

US 2021/0239384 A1 Aug. 5, 2021

(30) Foreign Application Priority Data

Feb. 5, 2020 (KR) ..... 10-2020-0013422

(51) Int. Cl.

| | |
|---|---|
| ***F28D 21/00*** | (2006.01) |
| ***F25D 21/00*** | (2006.01) |
| ***F25D 21/12*** | (2006.01) |
| ***F25D 21/14*** | (2006.01) |
| ***F28D 15/02*** | (2006.01) |

(52) U.S. Cl.

CPC ..... *F25D 21/12* (2013.01); *F25D 21/006* (2013.01); *F25D 21/14* (2013.01); *F28D 15/02* (2013.01); *F25D 2321/146* (2013.01)

(58) Field of Classification Search

CPC ..... F25D 21/12; F25D 21/14; F25D 21/00; F25D 21/006; F25D 2321/146; F28F 1/325; F28F 19/006; F28D 1/0477; F28D 15/02; F28D 1/0408; F28D 2021/0071

See application file for complete search history.

(56) References Cited

U.S. PATENT DOCUMENTS

| | | | |
|---|---|---|---|
| 7,028,499 | B2 | 4/2006 | Kwon et al. |
| 10,408,525 | B2 | 9/2019 | Shin et al. |
| 2005/0081548 | A1 | 4/2005 | Lee et al. |

(Continued)

FOREIGN PATENT DOCUMENTS

| | | | |
|---|---|---|---|
| CN | 201772430 U | * | 3/2011 |
| CN | 206504506 U | | 9/2017 |
| JP | 2012122652 A | * | 6/2012 |

(Continued)

OTHER PUBLICATIONS

International Search Report and Written Opinion of the Searching Authority dated Jun. 1, 2021 from International Application No. PCT/KR2021/001352.

*Primary Examiner* — Harry E Arant

(74) *Attorney, Agent, or Firm* — STAAS & HALSEY LLP

(57) ABSTRACT

A refrigerator includes a storage space, an evaporator configured to cool air in the storage space based on heat exchange of a refrigerant, and a defroster configured to remove frost formed on the evaporator. The defroster incudes a pipe extended around the evaporator and including a circulation channel through which working fluid circulates, a fluid storage including a first opening and a second opening respectively communicating with opposite end portions of the pipe and configured to store the working fluid, and a pumping part disposed at a selected position on the circulation channel of the pipe between the evaporator and the fluid storage and configured to vaporize the working fluid to circulate the vaporized working fluid in the circulation channel.

19 Claims, 20 Drawing Sheets

(56) References Cited

U.S. PATENT DOCUMENTS

2017/0131018 A1* 5/2017 Shin ..... F25D 21/06

FOREIGN PATENT DOCUMENTS

| | | | |
|---|---|---|---|
| KR | 10-1998-0023161 | A | 7/1998 |
| KR | 10-0494389 | B1 | 6/2005 |
| KR | 10-1125827 | B1 | 3/2012 |
| KR | 101437938 | B1 * | 9/2014 |
| KR | 10-2016-0046713 | | 4/2016 |
| KR | 10-2017-0055305 | | 5/2017 |
| KR | 10-1742587 | | 6/2017 |

* cited by examiner

REFRIGERATOR

CROSS-REFERENCE TO RELATED APPLICATIONS

This application is based on and claims priority under 35 U.S.C. § 119 to Korean Patent Application No. 10-2020-0013422 filed on Feb. 5, 2020 in the Korean Intellectual Property Office, the disclosure of which is incorporated by reference herein in its entirety.

BACKGROUND

1. Field

The disclosure relates to a refrigerator, and more particularly to a defroster that removes frost covering an evaporator of a refrigerator.

2. Description of the Related Art

An original function of a refrigerator is to keep food fresh for long. To this end, the refrigerator employs a cooling system including a compressor, a condenser, an evaporator, etc. to lower the temperature of a freezer compartment or a refrigerator compartment as desired. In this case, air introduced into the freezer compartment or the refrigerator compartment exchanges heat with the evaporator and becomes cold air. Further, moisture in air is attached to the surface of the evaporator. Then, frost continuously accumulated on the surface of the evaporator and decreases a heat-exchange efficiency. To maintain heat-exchange performance, a conventional refrigerator performs defrosting by regularly operating a heater placed below the evaporator. In this case, defrosting water from melting frost drains into a defrosting water tray through a drain hose connected to a lower drain plate.

The frost formed on the evaporator is melted by radiant and convection energy from the surface of the heater installed below. However, a considerable amount of input energy causes temperature to increase in the evaporator, the shelf and the inside of the refrigerator, and thus lowers an energy efficiency because temperature needs to be decreased as much as the increased temperature when the refrigerator operates.

SUMMARY

An aspect of the disclosure is to provide a refrigerator in which frost covering an evaporator is efficiently removed.

According to an embodiment of the disclosure, there is provided a refrigerator with a storage space. The refrigerator includes an evaporator configured to cool air in the storage space based on heat exchange of a refrigerant, and a defroster configured to remove frost formed on the evaporator. The defroster includes a piping configured to go via the evaporator and including a circulation channel through which working fluid circulates, a fluid storage including a first opening and a second opening respectively communicating with opposite end portions of the piping and configured to store the circulating working fluid, a pumping part provided at a certain position on the circulation channel of the piping between the evaporator and the fluid storage and configured to vaporize the working fluid to circulate the working fluid in the circulation channel.

The first opening may be positioned lower than the second opening, and the pumping part may be provided at a certain position on the circulation channel between the first opening of the first storage and the evaporator.

The piping may be provided at an upper position than the fluid storage.

The first opening may be provided lower than a level of the working fluid, and the second opening may be provided higher than the level of the working fluid.

The pumping part may include a thermal conductive block including a fluid passage through which the working fluid passes, and a heater provided in the thermal conductive block and configured to generate heat.

The thermal conductive block may include at least one of aluminum, copper or iron.

The defroster further may include a drain plate provided below the evaporator and configured to collect defrosting water from melting frost.

At least one of the thermal conductive block or the fluid storage may be provided to be in contact with the drain plate.

The pumping part may include a pipe connector configured to connect the piping to the fluid passage of the thermal conductive block.

The pipe connector may include a lower thermal-conductivity material than the piping.

The pipe connector may include a material of low thermal conductivity, and the piping may include a material of high thermal conductivity.

The piping may include a first piping, the circulation channel may include a first circulation channel, and the defroster may further include at least one second piping with a second circulation channel returned from the fluid storage via the pumping part and the evaporator.

The pumping part may include a thermal conductive block including a first fluid passage through which the working fluid of the first piping passes, and a second fluid passage through which the working fluid of the second piping passes.

The piping may include a first piping configured to go via a first area of the evaporator, and a second piping configured to go via a second area of the evaporator, the fluid storage may include a first fluid storage provided on a circulation channel between a first end portion of the first piping and a first end portion of the second piping, the pumping part may include a first pumping part provided on a circulation channel between the first area and the first opening of the first fluid storage, and the defroster may include a second fluid storage provided on a circulation channel between a second end portion of the first piping and a second end portion of the second piping, and configured to store the working fluid, and a second pumping part provided on the circulation channel of the second piping part between the second fluid storage and the second area.

The fluid storage may include a first fluid storage configured to store a first working fluid, the piping may include a first piping configured to go via a first area of the evaporator, the pumping part may include a first pumping part provided on a first circulation channel between a first area of the evaporator and the first fluid storage, and the defroster may include a second piping configured to go via a second area of the evaporator, and including a second circulation channel in which a second working fluid circulates, a second fluid storage including a third opening and a fourth opening respectively communicating with opposite end portions of the second piping, and configured to store second working fluid, and a second pumping part provided at a certain position on the second circulation channel of the second piping between the second area of the evaporator and the second fluid storage, and configured to vaporize the second working fluid to circulate the second working fluid in the second circulation channel.

The first pumping part may include a first thermal conductive block with a first fluid passage through which working fluid of the first piping passes, the second pumping part may include a second thermal conductive block with a second fluid passage through which working fluid of the second piping passes, and the defroster may include a heater interposed between the first thermal conductive block and the second thermal conductive block.

The piping may include a first piping, the pumping part may include a first pumping part, the fluid storage may further include a third opening and a fourth opening, and the defroster may include a second piping configured to go via the evaporator, and including opposite end portions respectively communicating with the third opening and the fourth opening of the fluid storage, and a second circulation channel in which the working fluid flows between the opposite end portions, and a second pumping part provided at a certain position on the second circulation channel of the second piping between the evaporator and the fluid storage, and configured to vaporize the working fluid to circulate the working fluid in the second circulation channel.

The pumping part may be configured to move the vaporized working fluid along a circulation channel far away from the fluid storage.

The pumping part may be configured to be closer to the first opening than the second opening.

The pumping part may be configured to pump the working fluid based on expansion and contraction of the working fluid.

BRIEF DESCRIPTION OF THE DRAWINGS

The above and/or the aspects will become apparent and more readily appreciated from the following description of exemplary embodiments, taken in conjunction with the accompanying drawings, in which.

DETAILED DESCRIPTION

Below, embodiments of the disclosure will be described in detail with reference to the accompanying drawings so as to be easily realized by a person having ordinary knowledge in the art to which the disclosure pertains. The disclosure may be embodied in various different forms, but not limited to the embodiments set forth herein.

Figure 1:
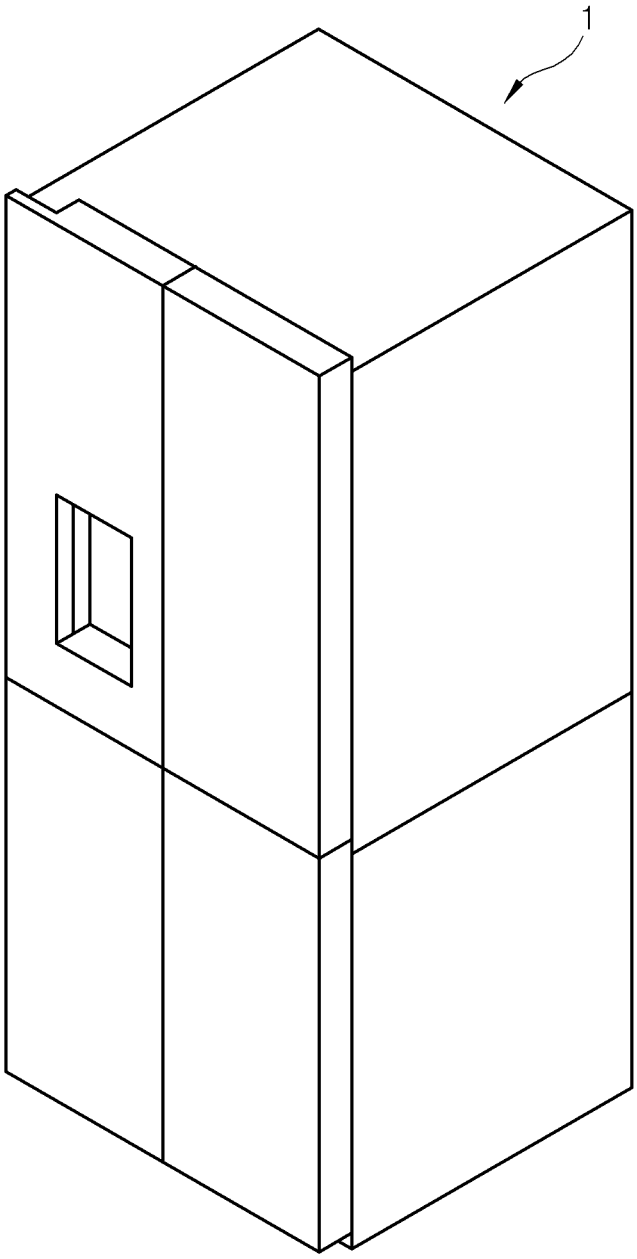
FIG. 1 is a perspective view of a refrigerator according to a first embodiment of the disclosure.

FIG. 1 is a perspective view of a refrigerator according to a first embodiment of the disclosure.

The refrigerator 1 according to the first embodiment of the disclosure may for example be embodied by a general-type, double-door type, or three to four-door type refrigerator according to the number of doors and methods of opening the door.

Further, the refrigerator 1 according to the disclosure may for example be embodied by a 1-EVA, 2-EVA, or 3-EVA type refrigerator according to the number of evaporators for supplying cool air.

Further, the refrigerator 1 according to the first embodiment of the disclosure may include a refrigerator having a refrigerator compartment and a freezer compartment where ice is made, a freezer having a freezer compartment for making ice, or an ice maker only for making ice.

Further, the refrigerator 1 according to the first embodiment of the disclosure may include an indirect-cooling type or direct-cooling type standing refrigerator or a built-in premium freezer.

As described above, the refrigerator 1 according to the disclosure may be not limited by many various structures or uses, but embodied by all the kinds of refrigerators having the refrigerator compartment or the freezer compartment.

Figure 2:
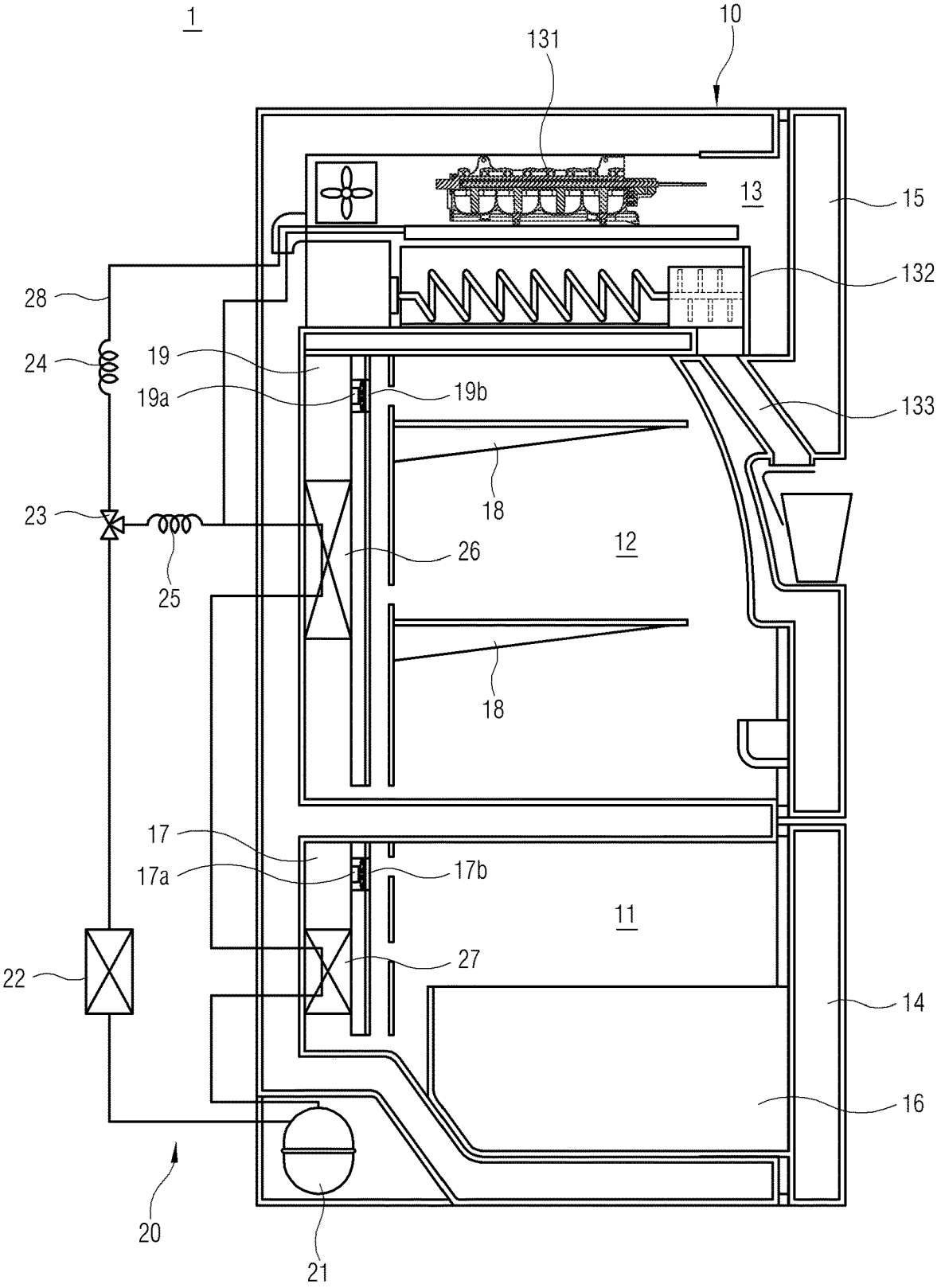
FIG. 2 is a lateral cross-section view schematically showing the refrigerator according to the first embodiment of the disclosure.

FIG. 2 is a lateral cross-section view schematically showing the refrigerator 1 according to the first embodiment of the disclosure;

Referring to FIG. 2, the refrigerator 1 may include a main body 10 which includes a freezer compartment 11, a refrigerator compartment 12 and an ice-making compartment 13, and a cooling system 20 which supplies cold air to the freezer compartment 11, the refrigerator compartment 12 and the ice-making compartment 13.

The main body 10 may include a freezer compartment door 14 for opening/closing the freezer compartment 11, and a refrigerator compartment door 15 for opening/closing the refrigerator compartment 12.

A user may open the freezer compartment door 14 to store things in the freezer compartment 11. The freezer compartment 11 may be provided with a freezing box 16, and a user may keep things frozen in the freezing box 16.

The freezer compartment 11 may be provided with a first cold-air supplying duct 17 on a rear wall. The first cold-air supplying duct 17 may be provided with a freezer-compartment evaporator 27 of the cooling system 20, and a freezer fan 17*a*, and a freezer-compartment cold-air outlet 17*b*. The freezer fan 17*a* may be configured to supply cold air, with which heat is exchanged by the freezer-compartment evaporator 27, to the freezer compartment 11 through the freezer-compartment cold-air outlet 17*b*.

A user may open the refrigerator compartment door 15 to store things in the refrigerator compartment 12. The refrigerator compartment 12 may be provided with a plurality of shelves 18, and a user may put things on the selves 18 and keep the things refrigerated.

The refrigerator compartment 12 may be provided with a second cold-air supplying duct 19 on the rear wall. The second cold-air supplying duct 19 may be provided with a refrigerator-compartment evaporator 26 of the cooling system 20, and a refrigerator fan 19*a*. A refrigerator-compartment cold-air outlet 19*b* may be provided between the second cold-air supplying duct 19 and the refrigerator compartment 12. The refrigerator fan 19*a* may be configured to supply cold air, with which heat is exchanged by the refrigerator-compartment evaporator 26, to the refrigerator compartment 12 through the refrigerator-compartment cold-air outlet 19*b*.

The ice-making compartment 13 is partitioned from the refrigerator compartment 12 by an ice-making compartment casing forming a predetermined space therein, and insulated from the refrigerator compartment 12.

The ice-making compartment 13 may be provided with an ice-making unit 131 for making ice, and an ice-storage container 132 for storing ice made by the ice-making unit 131. The ice stored in the ice-storage container 132 may be discharged through a duct 133.

The cooling system 20 may include a compressor 21, a condenser 22, a switching valve 23, a first expansion valve 24, a second expansion valve 25, the evaporators 26 and 27, and a refrigerant pipe 28. Below, only the evaporator 26 of the freezer compartment 11 will be representatively described because the evaporator 26 of the freezer compartment 11 is structurally analogous to the evaporator 27 of the refrigerator compartment 12.

The compressor 21 compresses a refrigerant into gas of high temperature and high pressure. Specifically, the compressor 21 may include a motor to compress the refrigerant.

The condenser 22 condenses the gaseous refrigerant of high temperature and high pressure supplied from the compressor 21 into liquid by heat exchange with external air.

The switching valve 23 selectively supplies the liquefied refrigerant from the condenser 22 to the ice-making compartment 13 or the evaporator of the freezer compartment 11.

The first expansion valve 24 makes the refrigerant of low temperature and high pressure to be supplied to the ice-making compartment 13 pass through a capillary tube and thus have low pressure.

The second expansion valve 25 makes the refrigerant of low temperature and high pressure to be supplied to the evaporator 26 pass through a capillary tube and thus have low pressure.

The evaporator 26 makes the refrigerant of low temperature and low pressure coming through the second expansion valve 25 perform heat exchange with air of the freezer compartment 11 and the refrigerator compartment 12. Based on the cooling cycle of the refrigerant, the evaporator 26 evaporates the refrigerant while the liquefied refrigerant of low temperature low pressure moves along a refrigerant pipe of the evaporator 26. Further, the evaporator 26 makes the refrigerant absorb heat, which is necessary for evaporation, from ambient air. Thus, cold air cooled by the evaporator 26 may be formed around the evaporator 26. In this case, relative humidity is lowered as air is cooled around the evaporator 26, thereby causing condensation that water vapor contained in air passing through the evaporator 26 is condensed. Further, water of which temperature is below its freezing point is frozen and formed as frost on the surface of the evaporator 26. Alternatively, water vapor in air may be sublimated into frost by colliding with the surface of the evaporator 26 having low temperature.

The refrigerant flowing in the refrigerant pipe 28 is discharged from the compressor 21 and supplied to the evaporator 26 provided in the refrigerator compartment and the freezer compartment via the condenser 22 and the second expansion valve 25.

Figure 3:
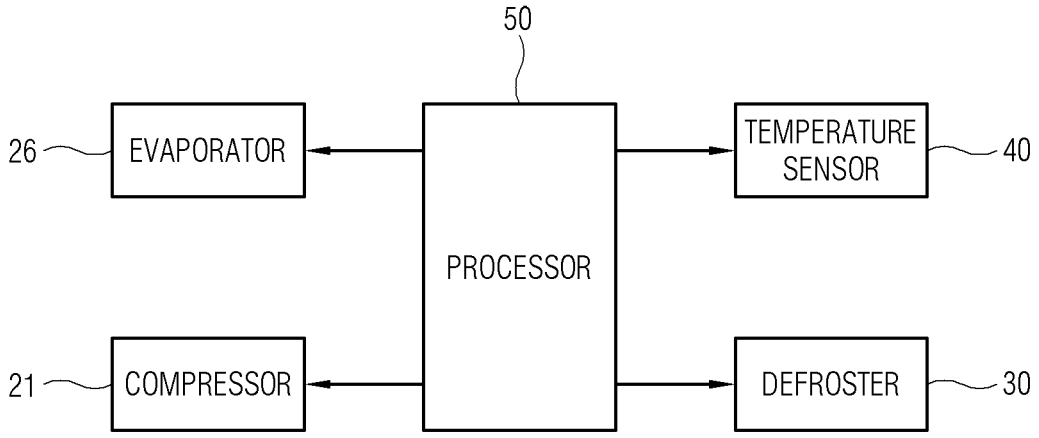
FIG. 3 is a block diagram of the refrigerator according to the first embodiment of the disclosure.

FIG. 3 is a block diagram of the refrigerator 1 according to the first embodiment of the disclosure.

Referring to FIG. 3, the refrigerator 1 may include the compressor 21, the evaporator 26, a defroster 30, a temperature sensor 40, and a processor 50. Here, the compressor 21 and the evaporator 26 were described above with reference to FIG. 2, and thus repetitive descriptions thereof will be avoided.

The defroster 30 can remove frost from the evaporator 26. Specifically, the defroster 30 may generate heat and melt frost covering the evaporator 26. The structure and operations of the defroster 30 will be described later.

The temperature sensor 40 detects temperature around the evaporator 26. Specifically, the temperature sensor 40 may be placed at one side of the evaporator 26 and detect temperature to identify phase transition of the frost covering the evaporator 26. Here, the temperature sensor 40 may be placed at a position spaced apart from the defroster 30 to make sure whether the front covering the evaporator 26 is completely removed.

The processor 50 controls the elements of the refrigerator 1. Specifically, the processor 50 may control the defroster 30 for a defrosting operation to defrost the evaporator 26.

The processor 50 may identify whether a defrosting signal for carrying out the defrosting operation of the defroster 30 is input. The defrosting signal may be a signal detected by the temperature sensor 40.

Alternatively, the processor 50 may generate the defrosting signal when input information satisfies a certain condition. For example, the processor 50 may generate the defrosting signal when accumulated time in a timer for measuring an operating time of the compressor 21 reaches a preset time.

Alternatively, the processor 50 may generate the defrosting signal based on a value sensed by a sensor using light for detecting an accumulated amount of frost covering the evaporator 26 or a sensor for detecting electric capacity between heat-exchanging fins of the evaporator 26.

The processor 50 may control the defroster 30 until a preset condition for completing the defrosting operation is satisfied, for example, until a defrosting time or a temperature sensed at the evaporator 26 reaches a predetermined threshold.

The processor 50 includes at least one general-purpose processor that loads at least a part of a control program from a nonvolatile memory installed with the control program to a volatile memory and executes the loaded control program, and may for example be embodied by a central processing unit (CPU), an application processor (AP), or a microprocessor.

The processor 50 may include a single-core processor, a dual-core processor, a triple-core processor, a quad-core processor, or the like multiple-core processor. The processor 50 may include a plurality of processors. The processor 50 may for example include a main processor and a sub processor that operates in a sleep mode (e.g. a mode where only standby power is supplied). Further, the processor, the read only memory (ROM), and the random access memory (RAM) may be connected to one another through an internal bus.

The processor 50 may be embodied as included in a main system on chip (SoC) to be mounted to a printed circuit board (PCB) internally provided in the refrigerator 1.

The control program may include a program(s) achieved by at least one of a basic input/output system (BIOS), a device driver, an operating system (OS), a firmware, a platform, or an application. The application may be previously installed or stored in the refrigerator 1 when the refrigerator 1 is manufactured, or may be installed in the refrigerator 1 on the basis of application data received from the outside when it is required in the future. The application data may for example be downloaded from an external server such as an application market to the refrigerator 1. Such an external server is merely an example of the computer program product, but not limited thereto.

Figure 4:
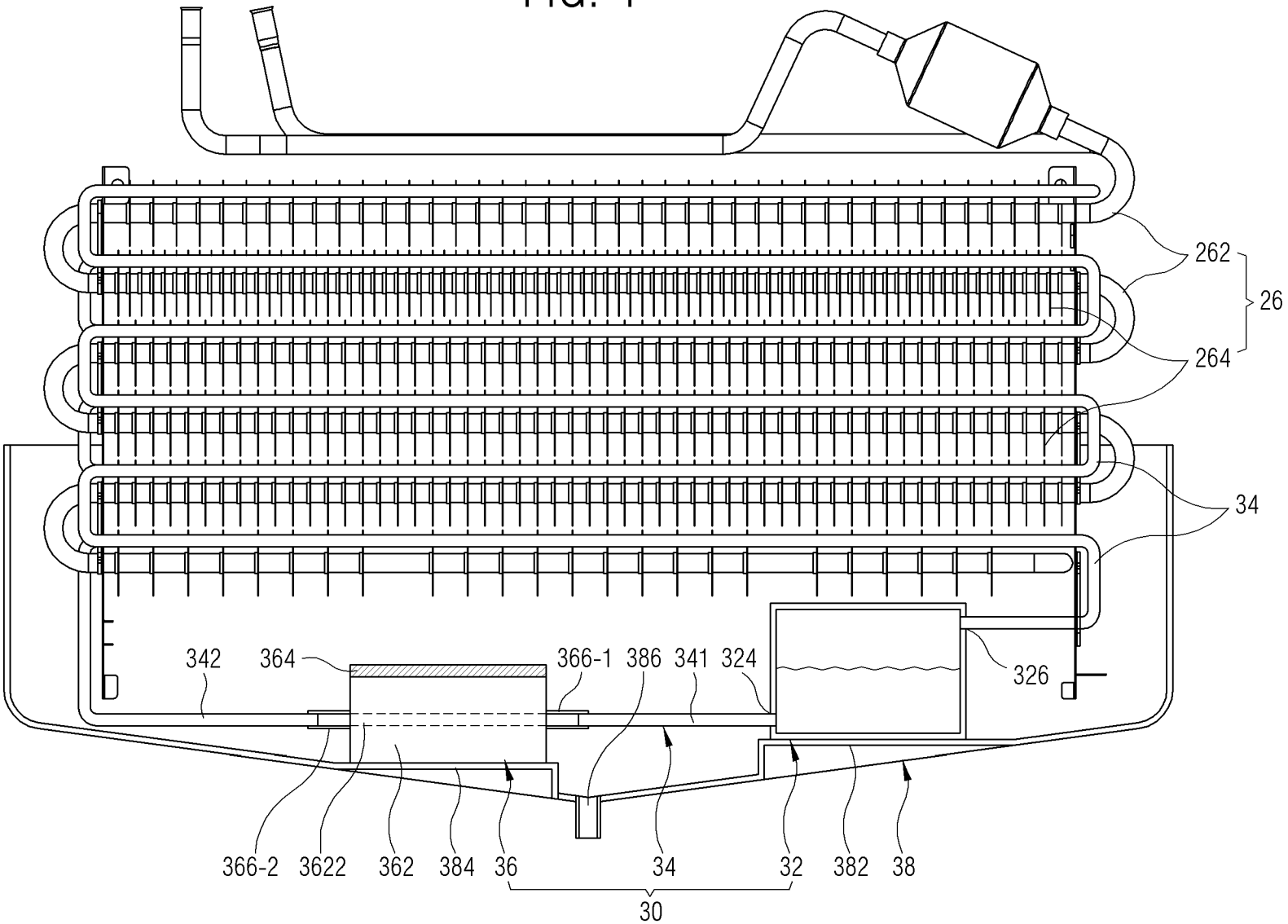
FIG. 4 illustrates a defroster installed in an evaporator according to the first embodiment of the disclosure.
Figure 5:
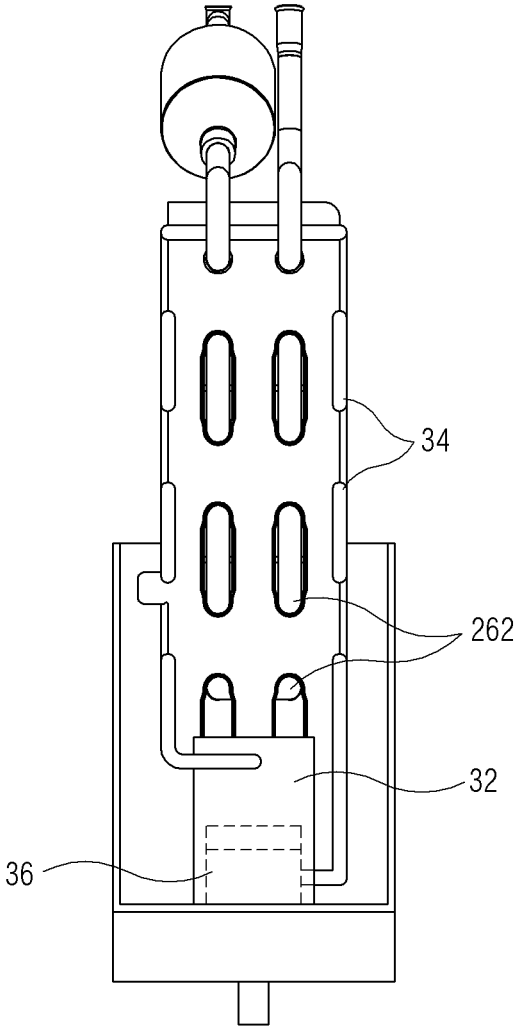
FIG. 5 is a lateral view of the defroster installed in the evaporator according to the first embodiment of the disclosure.
Figure 6:
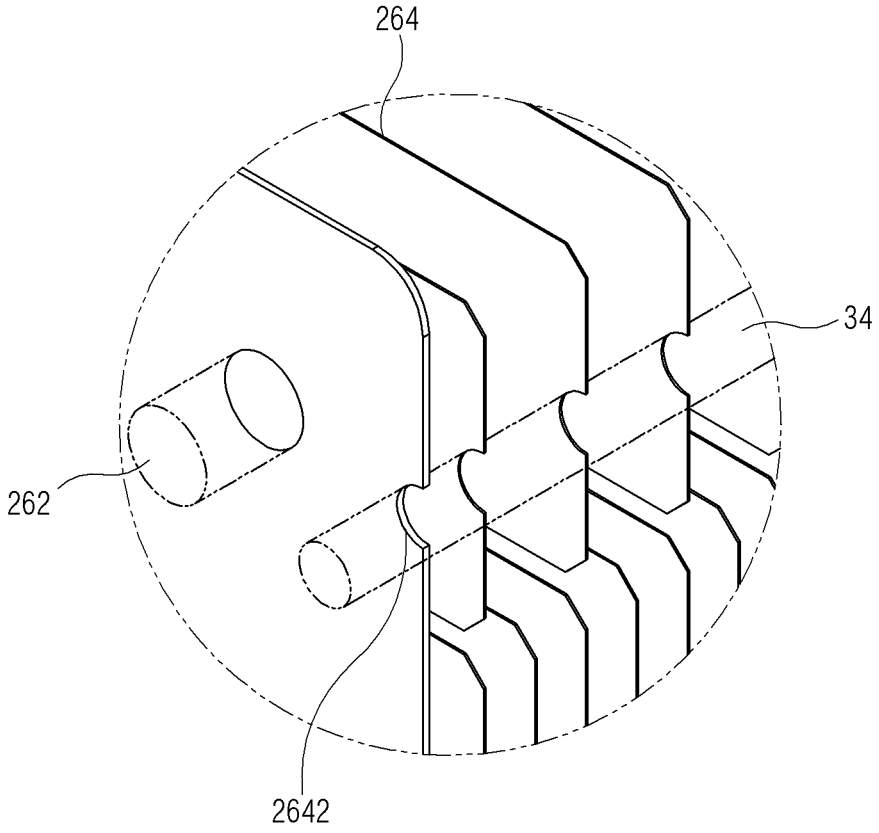
FIG. 6 illustrates a piping installed in an evaporator according to an embodiment of the disclosure.
Figure 7:
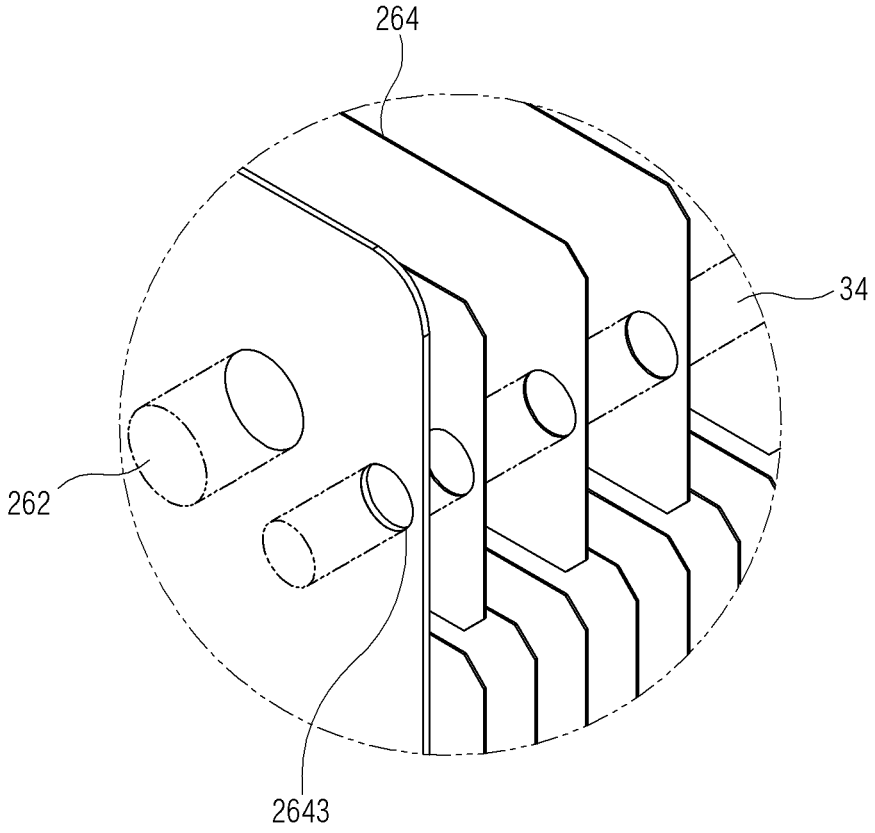
FIG. 7 illustrates a piping installed in an evaporator according to another embodiment of the disclosure.
Figure 8:
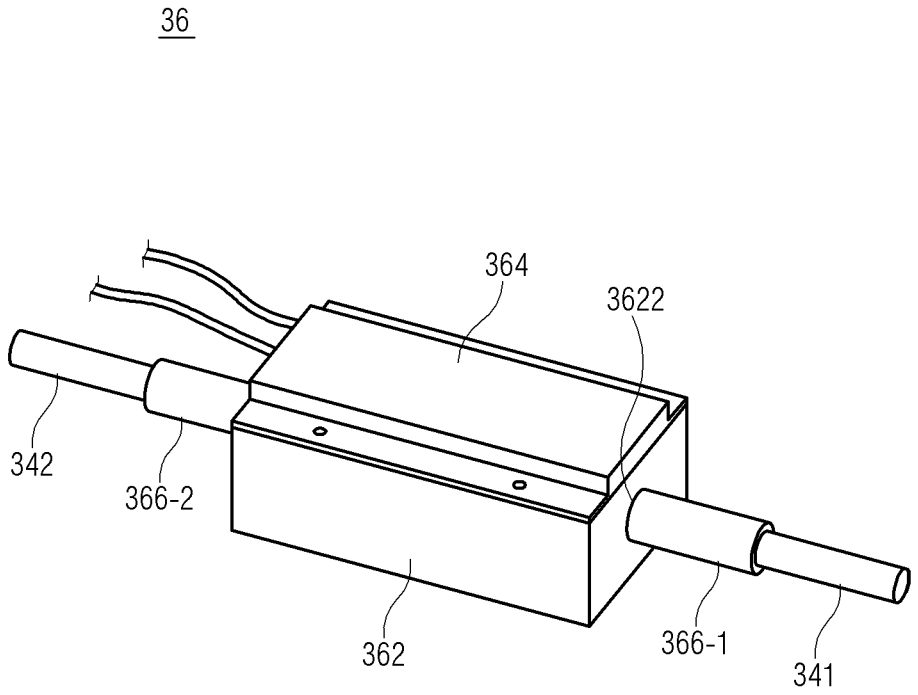
FIG. 8 illustrates a structure of a pumping part.

FIG. 4 illustrates the defroster 30 installed in the evaporator 26 according to the first embodiment of the disclosure, FIG. 5 is a lateral view of the defroster 30 installed in the evaporator 36 according to the first embodiment of the disclosure, FIG. 6 illustrates a piping 34 installed in an evaporator 26 according to an embodiment of the disclosure, FIG. 7 illustrates a piping 34 installed in an evaporator 26 according to another embodiment of the disclosure, and FIG. 8 illustrates a structure of a pumping part 36.

Referring to FIGS. 4 and 5, the evaporator 26 may include a refrigerant pipe 262 through which the refrigerant is transferred, and a plurality of heat-exchanging fins 264 installed to be in contact with the refrigerant pipe 262. Referring to FIG. 5, the refrigerant pipe 262 is extended in two parallel rows when viewed from the side.

The defroster 30 may include a fluid storage 32 in which working fluid is stored, a piping 34 in which the working fluid flows, a pumping part 36, and a drain plate 38.

The fluid storage 32 may be filled with the working fluid at a certain level. The working fluid may for example include water, freon refrigerant, ammonia, acetone, methanol, ethanol, or a mixture thereof. For example, the working fluid may include acetone which has a freezing point of −94° C. not to be frozen at the lowest temperature of the refrigerator 1, e.g. about −30° C. and a boiling point of 56° C. higher than a room temperature.

The fluid storage 32 may include a first opening 324 through which the working fluid goes out, and a second opening 326 through which the working fluid comes in. The first opening 324 may be positioned lower than the second opening 326. The first opening 324 may be positioned lower than the level of the working fluid, and the second opening 326 may be positioned higher than the level of the working fluid.

The fluid storage 32 may be placed below the evaporator 26.

The fluid storage 32 may be provided to be in contact with the bottom of the drain plate 38. Specifically, the fluid storage 32 may be installed on a first mounting portion 382 protruding horizontally from an inclined bottom of the drain plate 38. The fluid storage 32 may store the working fluid in a liquid phase of e.g. about 30~40° C. as the working fluid in a gas phase heated e.g. at 56° C. in the pumping part 36 exchanges heat with the frost on the evaporator 26. In result, the fluid storage 32 maintains a temperature for example at 30~40° C. while the pumping part 36 is continuously operating. Therefore, ice in the drain plate 38 may be melted by heat transferred by the fluid storage 32. Of course, the temperature of the working fluid in the liquid phase come back to and stored in the fluid storage 32 may be varied depending on a degree of exchanging heat between the heated work fluid in the gas phase and the evaporator 26, for example, depending on the length or diameter of the piping 34, and the ambient temperature of the evaporator 26. That is, the working fluid in the liquid phase may have a temperature lower than 30° C. when there is much frost or the ambient temperature of the evaporator 26 is low, and may have a temperature higher than 40° C. when there is less frost or the temperature of the evaporator 26 is high. When the pumping part 36 does not operate, the temperature of the working fluid in the fluid storage 32 may be decreased up to the temperature of the space where the evaporator 26 is installed, for example, up to −30° C.

The piping 34 may have ends respectively communicating with the first opening 324 and the second opening 326 of the fluid storage 32. The piping 34 may include a circulation channel in which the working fluid flows between both ends thereof.

The piping 34 may be extended from the first opening 324 of the fluid storage 32 along the refrigerant pipe 262 of the evaporator 26 via the pumping part 36 and connected to the second opening 326 of the fluid storage 32.

The piping 34 may include a first pipe 341 connecting the pumping part 36 and the first opening 324 of the fluid storage 32, and a second pipe 342 connecting the pumping part and the second opening 326 of the fluid storage 32.

The piping 34 may be extended from the fluid storage 32 and the pumping part 36 toward the evaporator 26 positioned higher than the fluid storage 32 and the pumping part 36.

The piping 34 may be more densely arrayed in a lower portion of the evaporator 26 because frost the lower portion of the evaporator 26 is more frosted than an upper portion thereof. For instance, the piping 34 may pass for example twice through the heat-exchanging fins 264 of the lower refrigerant pipe 262, but pass once through the heat-exchanging fins 264 of the upper refrigerant pipe 262.

Alternatively, the piping 34 passing through the heat-exchanging fins 264 of the lower refrigerant pipe 262 of the evaporator 26 may have a larger diameter than the piping 34 passing through the heat-exchanging fins 264 of the upper portion, thereby enlarging a contact area for heat exchange.

Referring to FIG. 6, the piping 34 may be installed to be in contact with the heat-exchanging fins 264 of the evaporator 26. The piping 34 may be fitted to opened grooves 2642 of the heat-exchanging fins 264.

Referring to FIG. 7, the piping 34 may be fitted to closed holes 2643 of the heat-exchanging fins 264.

The pumping part 36 may be provided at a certain position in the circulation channel of the piping 34, and vaporize the working fluid, thereby circulating the working fluid in the circulation channel.

The pumping part 36 may be installed below the evaporator 26.

The pumping part 36 may be installed on the circulation channel of the piping 34 closer to the first opening 324 than the second opening 326 of the fluid storage 32.

Referring to FIG. 8, the pumping part 36 may include a thermal conductive block 362, a heater 364, and first and second pipe connectors 366-1 and 366-2.

The thermal conductive block 362 may include a fluid passage 3622 through the working fluid passes. The working fluid passing through the thermal conductive block 362 may be vaporized by heat generated in the heater 364.

The thermal conductive block 362 may be shaped like a hexahedron or a cylinder.

The thermal conductive block 362 may include a highly thermal conductive material, for example, at least one of aluminum, copper or iron.

The thermal conductive block 362 may be installed to be in contact with the bottom of the drain plate 38 as shown in FIG. 4. Specifically, the thermal conductive block 362 may be installed on a second mounting portion 384 horizontally protruding from the inclined bottom of the drain plate 38. Thus, when the thermal conductive block 362 is heated by the heater 364, the drain plate 38 being in contact with the thermal conductive block 362 may also be heated. In result, ice remaining in the drain plate 38 may be melted by heat transferred from the thermal conductive block 362.

The heater 364 may generate heat when powered on. The heater 364 may be installed being in contact with one surface of the thermal conductive block 362. The heater 364 may operate by the processor 50 according to preset conditions. Specifically, the processor 50 may operate the heater when the temperature of the evaporator 26 sensed by the temperature sensor 40 provided in the evaporator 26 reaches a threshold value.

The heater 364 may be embodied by a positive temperature coefficient (PTC) heater.

The first pipe connector 366-1 may connect with the first pipe 341 for connection between the thermal conductive block 362 and the first opening 324 of the fluid storage 32. The first pipe connector 366-1 may include a material having lower thermal conductivity than the material of the first pipe 341, for example, silicon, rubber, synthetic resin, etc. In this case, the first pipe 341 may include a highly thermal conductive material, for example, copper, aluminum, iron, stainless steel, etc. The first pipe connector 366-1 having such low thermal conductivity interrupts heat transfer from the thermal conductive block 362 heated by the heater 364 toward the first pipe 341, thereby causing the working fluid in the gas phase moved to the first pipe 341 to smoothly contract.

The second pipe connector 366-2 may connect with the second pipe 342 for connection between the thermal conductive block 362 and the second opening 326 of the fluid storage 32. The second pipe connector 366-2 may include a material having lower thermal conductivity than the material of the second pipe 342, for example, silicon, rubber, synthetic resin, etc. In this case, the second pipe 342 may include a highly thermal conductive material, for example, copper, aluminum, iron, stainless steel, etc. The second pipe connector 366-2 having such low thermal conductivity interrupts heat transfer from the thermal conductive block 362 heated by the heater 364 toward the second pipe 342, thereby causing the working fluid in the gas phase moved to the second pipe 342 to smoothly contract.

The foregoing pumping part 36 includes the thermal conductive block 362 and the heater 364, but is not limited to this. The pumping part 36 may include any structure as long as it can vaporize the working fluid in the pipe 34. For example, the pumping part 36 may be embodied by a hot wire provided to surround the pipe 34.

Referring back to FIGS. 4 and 5, the drain plate 38 may be placed covering the bottom of the evaporator 26, and collect pieces of ice or defrosting water or from melting the frost on the evaporator 26.

The drain plate 38 may include the first mounting portion 382 on which the fluid storage 32 is installed, the second mounting portion 384 on which the pumping part 36 is installed, and a defrosting water outlet 386 through which the defrosting water is discharged. The first mounting portion 382 and the second mounting portion 384 may for example be formed to horizontally protrude at a predetermined height from a partial bottom of the drain plate 38 by press work. The defrosting water discharged through the defrosting water outlet 386 may be collected in a water tank through a hose.

The ice collected in the drain plate 38 may be melted by heat from the fluid storage 32 and/or the pumping part 36.

Figure 9:
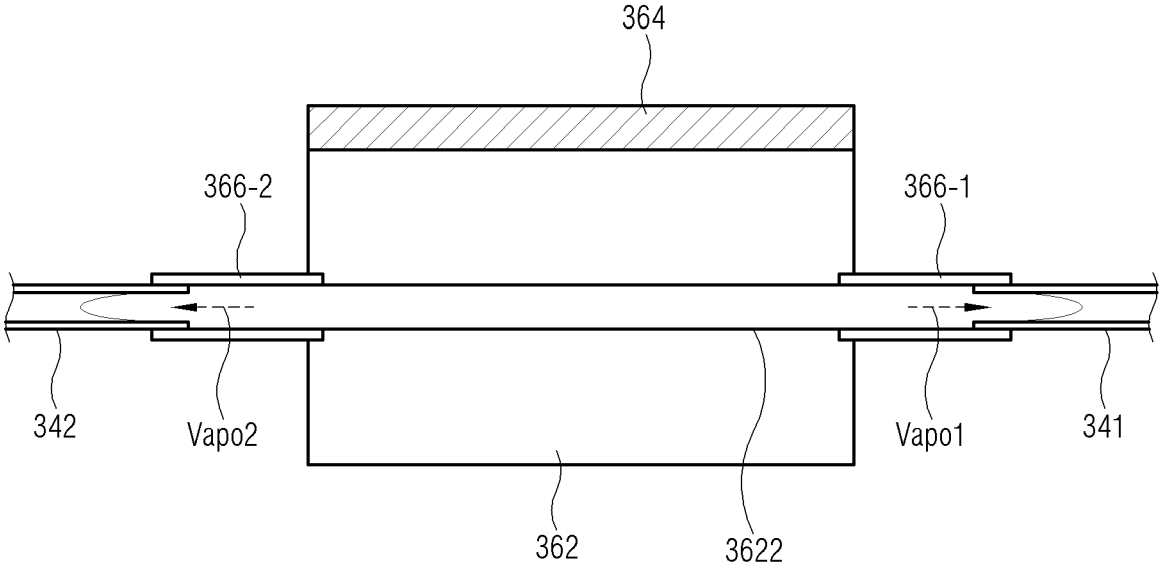
FIG. 9 illustrates an expansion state of the pumping part in FIG. 8.
Figure 10:
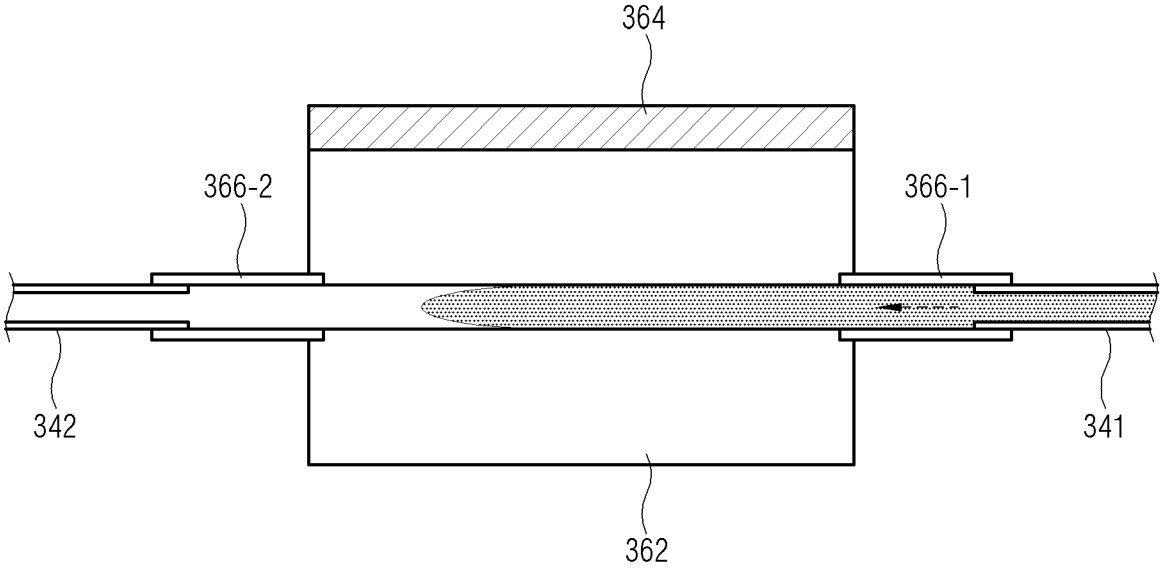
FIG. 10 illustrates a contraction state of the pumping part in FIG. 8.

FIG. 9 illustrates an expansion state of the pumping part 36 in FIG. 8, and FIG. 10 illustrates a contraction state of the pumping part 36 in FIG. 8.

Referring to FIG. 9, when the heater 364 operates, the working fluid in the liquid phase filled in the thermal conductive block 362 may be vaporized. In this case, the working fluid in the gas phase moves from the thermal conductive block 362 to both the first pipe 341 and the second pipe 342 as its volume is expanded. In this case, the working fluid in the gas phase expanded to the opposite sides farther moves toward the second pipe 342 empty or filled with the working fluid in the gas phase rather than the first pipe 341 filled with the working fluid in the liquid phase.

Referring to FIG. 10, the working fluid in the gas phase expanded toward both the first pipe 341 and the second pipe 342 may be contracted by heat exchange with an ambient atmosphere of the first pipe 341 and the second pipe 342, for example, cold air in a space where the evaporator 26 is placed and frost formed in the heat-exchanging fins 364 of the evaporator 26. In this case, the amount of working fluid in the gas phase moved to the second pipe 342 is more than that of the working fluid in the gas phase moved to the first pipe 341, and therefore the pressure at the second pipe 342 may become lower than that at the first pipe 341. With such difference in pressure, the working fluid in the liquid phase of the fluid storage 32 moves toward the second pipe 342 and is thus filled in the thermal conductive block 362.

When the expansion and contraction of the working fluid shown in FIGS. 9 and 10 are repeated, the pumping part 36 pumps the vaporized working fluid toward the second pipe 342 passing through the area of the evaporator 26 while repeating vaporization and suction of the working fluid.

Below, an operation principle of the defroster 30 will be described in detail.

Figure 11:
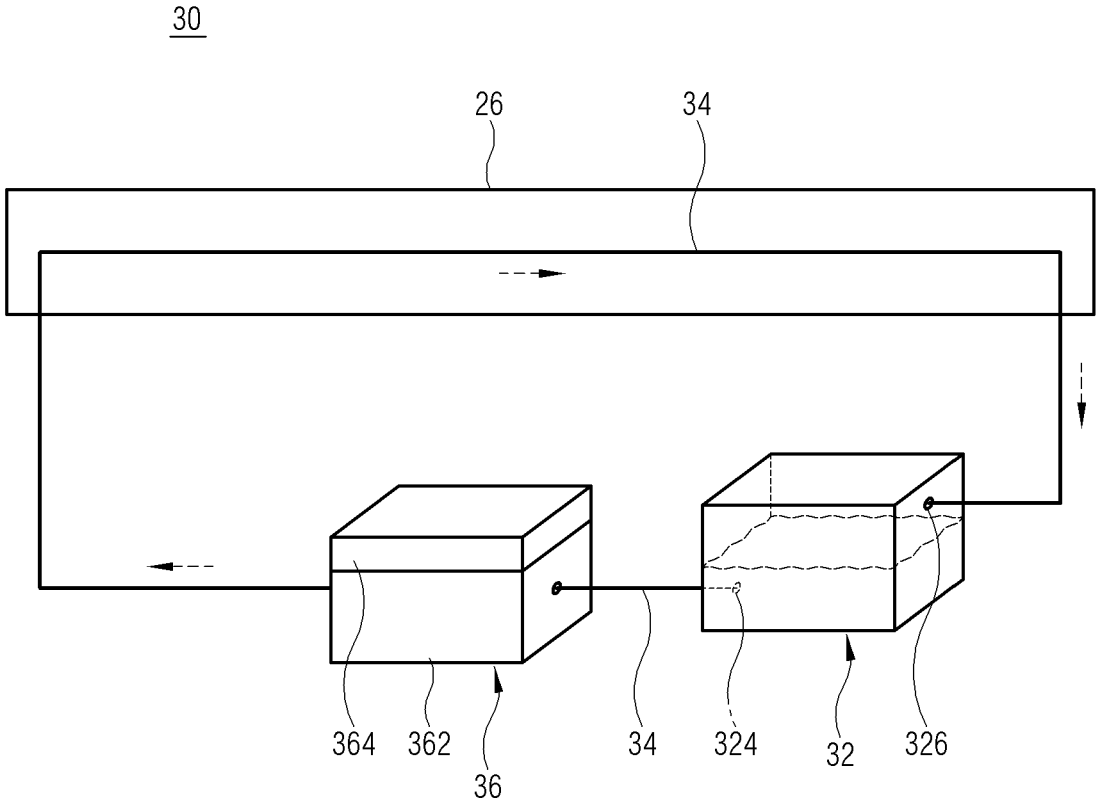
FIG. 11 illustrates a schematic configuration of the defroster according to the first embodiment of the disclosure.
Figure 12:
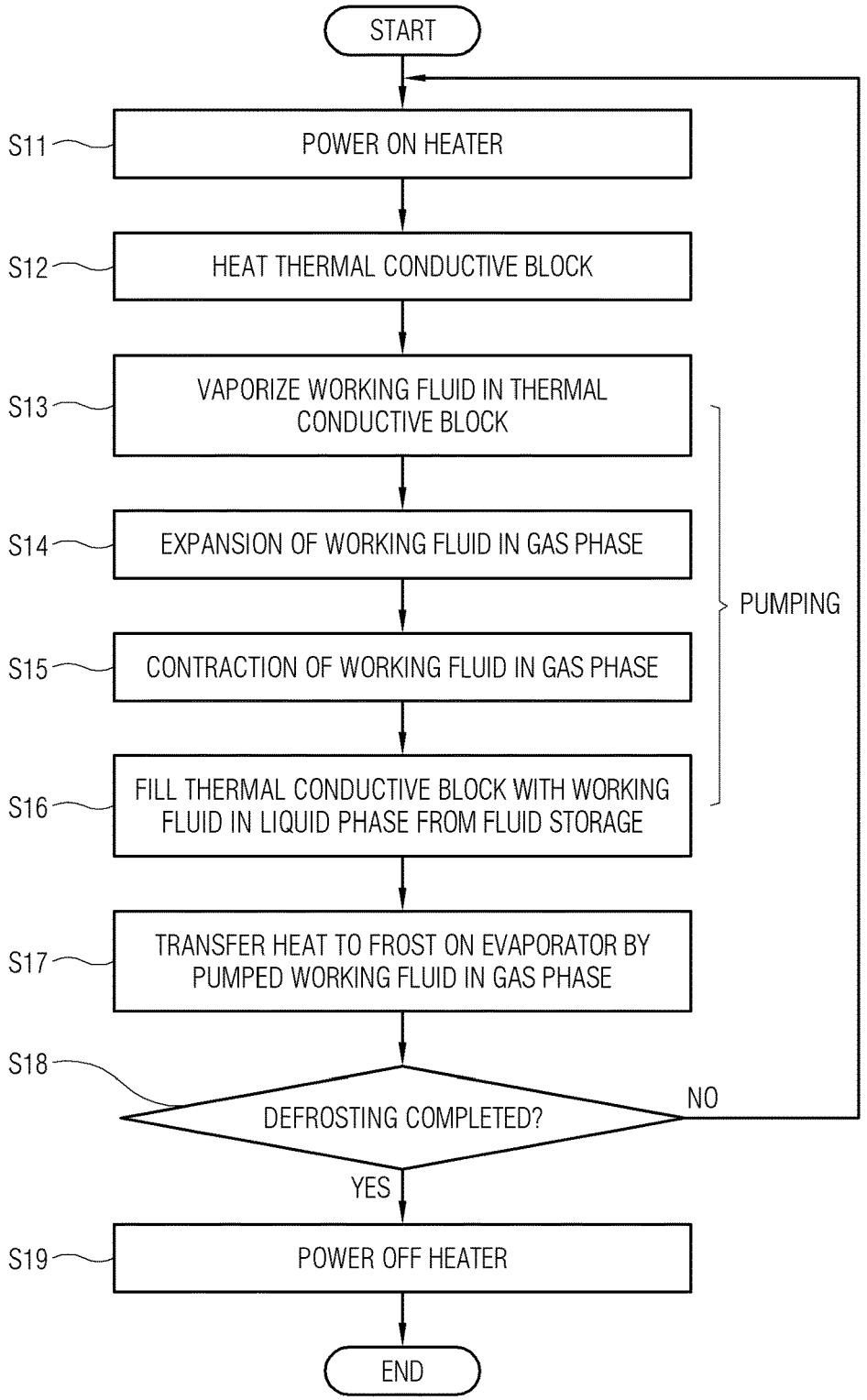
FIG. 12 is a flowchart showing a defrosting operation according to the first embodiment of the disclosure.

FIG. 11 illustrates a schematic configuration of the defroster 30 according to the first embodiment of the disclosure, and FIG. 12 is a flowchart showing a defrosting operation according to the first embodiment of the disclosure.

At operation S11, the processor 50 applies power to the heater 364 of the pumping part 36 when the defrosting operation starts.

At operation S12, heat generated by the heater 364 is transferred to the thermal conductive block 362.

At operation S13, when the thermal conductive block 362 is heated up to the boiling point, e.g. 56° C. of the working fluid, e.g. acetone, the working fluid of the piping 34 passing through the thermal conductive block 362 may be vaporized by the phase transition from liquid to gas.

At operation S14, the working fluid in the gas phase may be expanded toward both the first pipe 341 and the second pipe 342 of the thermal conductive block 362 by difference in density as shown in FIG. 9.

At operation S15, the working fluid in the gas phase expanded toward the first pipe 341 and the second pipe 342 may be contracted by dissipating heat toward the outside while the heat transfer is interrupted by the first and second pipe connectors 366-1 and 366-2 made of the low thermal conductive material.

At operation S16, the working fluid in the gas phase moved to the first and second pipe connectors 366-1 and 366-2 is contracted, and thus the working fluid in the liquid phase in the fluid storage 32 moves toward the second pipe 342 having lower pressure as shown in FIG. 10 and fills the thermal conductive block 362.

At operation S17, the vaporization, expansion, contraction and suction pumping shown in the operations S13 to S16 are repetitively performed.

The pumped working fluid in the gas phase is moved to the piping 34 in the area of the evaporator 26 and transfers heat to frost on the evaporator 36, thereby melting the frost.

At operation S18, the processor 50 checks a preset condition for completing the defrosting operation, for example, the defrosting time or the temperature of the heat-exchanging fins 264 of the evaporator 36. When the condition for completing the defrosting operation is not satisfied, the heater 364 is continuously powered on.

At operation S19, when the condition for completing the defrosting operation is satisfied, the heater 364 is powered off.

As described above, the defroster 30 according to the first embodiment of the disclosure pushes out the working fluid in the gas phase of high temperature toward the frost covering the evaporator 26 so that the working fluid can move to the second opening 326 of the fluid storage 32 after heat transfer, and pulls in the working fluid in the liquid phase of the fluid storage 32 toward the pumping part 36 through the first opening 324, thereby pumping the working fluid.

The defroster 30 according to the first embodiment of the disclosure performs one-way circulation pumping in which the pumping part 36 is fed with the working fluid in the liquid phase, the working fluid in the gas phase is pumped toward the evaporator 26 and contracted in the evaporator 26, and the working fluid in the liquid phase is returned to the fluid storage 32, thereby efficiently pumping the working fluid and thus improving a defrosting efficiency.

Further, the fluid storage 32 and the pumping part 36 are installed being in contact with the drain plate 38, thereby melting ice in the drain plate 38 at the defrosting operation.

Figure 13:
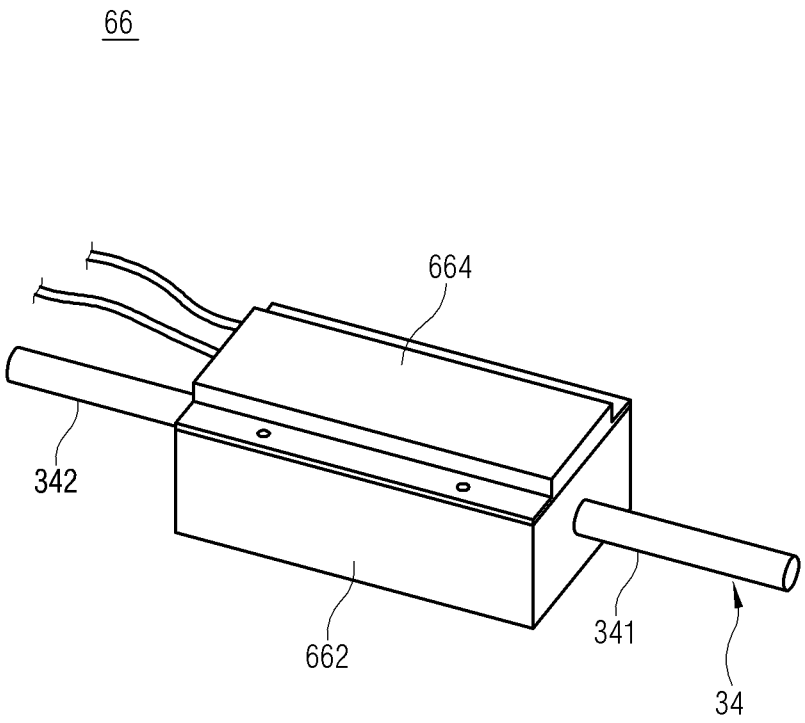
FIG. 13 is a perspective view showing a pumping part according to a second embodiment of the disclosure.

FIG. 13 is a perspective view showing a pumping part 66 according to a second embodiment of the disclosure.

Referring to FIG. 13, the pumping part 66 may include a thermal conductive block 662, and a heater 664.

In the pumping part 66 according to the second embodiment, unlike the pumping part 36 according to the first embodiment shown in FIG. 8, the first pipe 341 and the second pipe 342 may be directly connected to the thermal conductive block 662 without the first and second pipe connectors 366-1 and 366-2.

Alternatively, one of the first pipe 341 and the second pipe 342 may be directly connected to the thermal conductive block 662, but the other one may be connected via the pipe connector.

Figure 14:
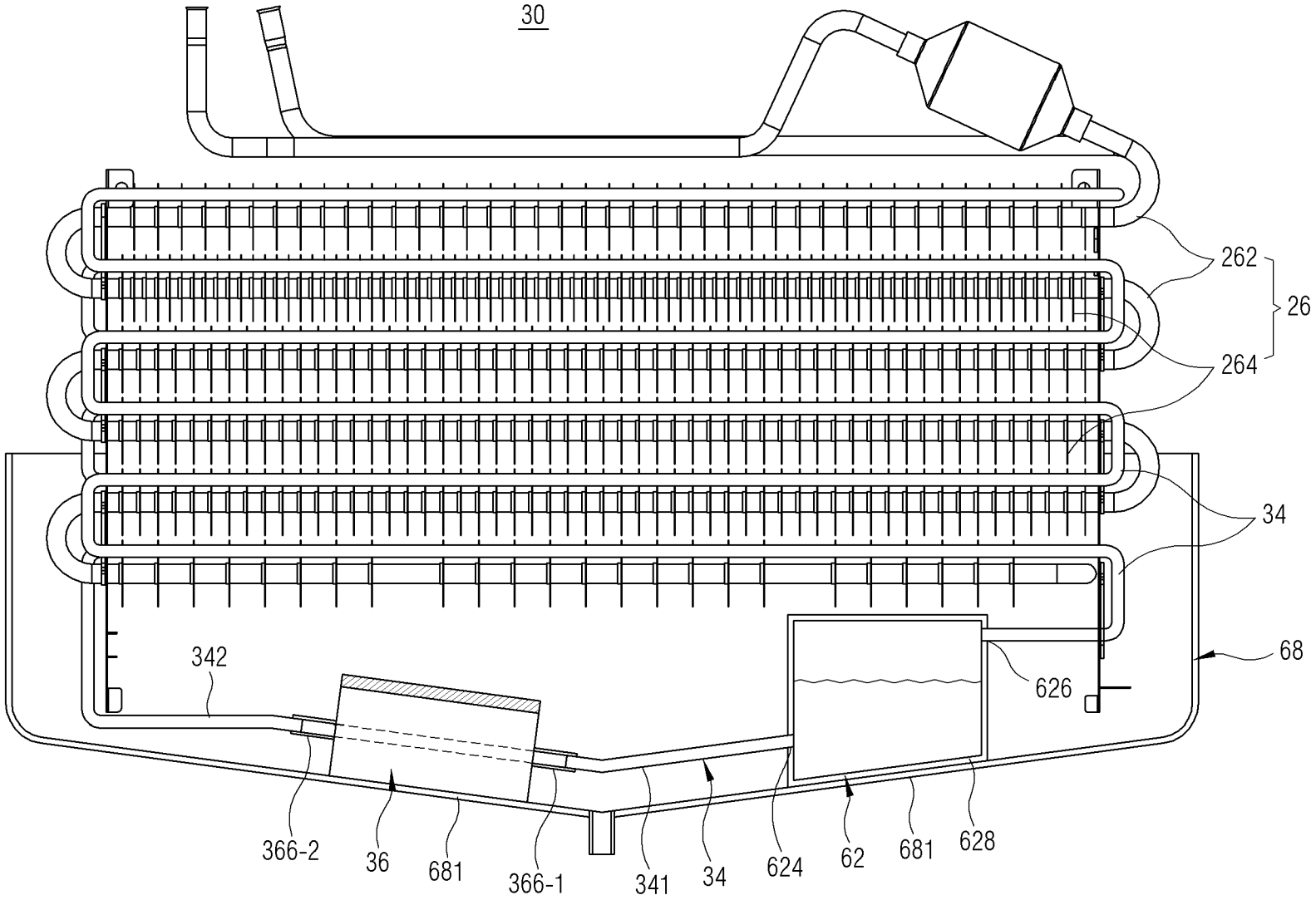
FIG. 14 illustrates a defroster installed in an evaporator according to a third embodiment of the disclosure.

FIG. 14 illustrates a defroster 30 installed in an evaporator 26 according to a third embodiment of the disclosure.

Referring to FIG. 14, the defroster 30 may include a fluid storage 62 in which working fluid is stored, a piping 34 in which the working fluid flows, a pumping part 36, and a drain plate 68.

The fluid storage 62 may include an inclined second bottom portion 628 being in contact with an inclined first bottom portion 681 of the drain plate 68. In result, the fluid storage 62 is vertically mounted onto the inclined first bottom portion 681 of the drain plate 68 without inclination.

The first pipe 341 of the piping 34 may be extended to be in parallel with the inclined first bottom portion 681 of the drain plate 68.

The pumping part 36 may be mounted onto the inclined first bottom portion 681 of the drain plate 68 as inclined.

Thus, the drain plate 68 of the defroster 30 according to the third embodiment excludes the first mounting portion 382 for the installation of the fluid storage 32 and the second mounting portion 384 for the installation of the pumping part 36, unlike the drain plate 38 shown in FIG. 4.

Figure 15:
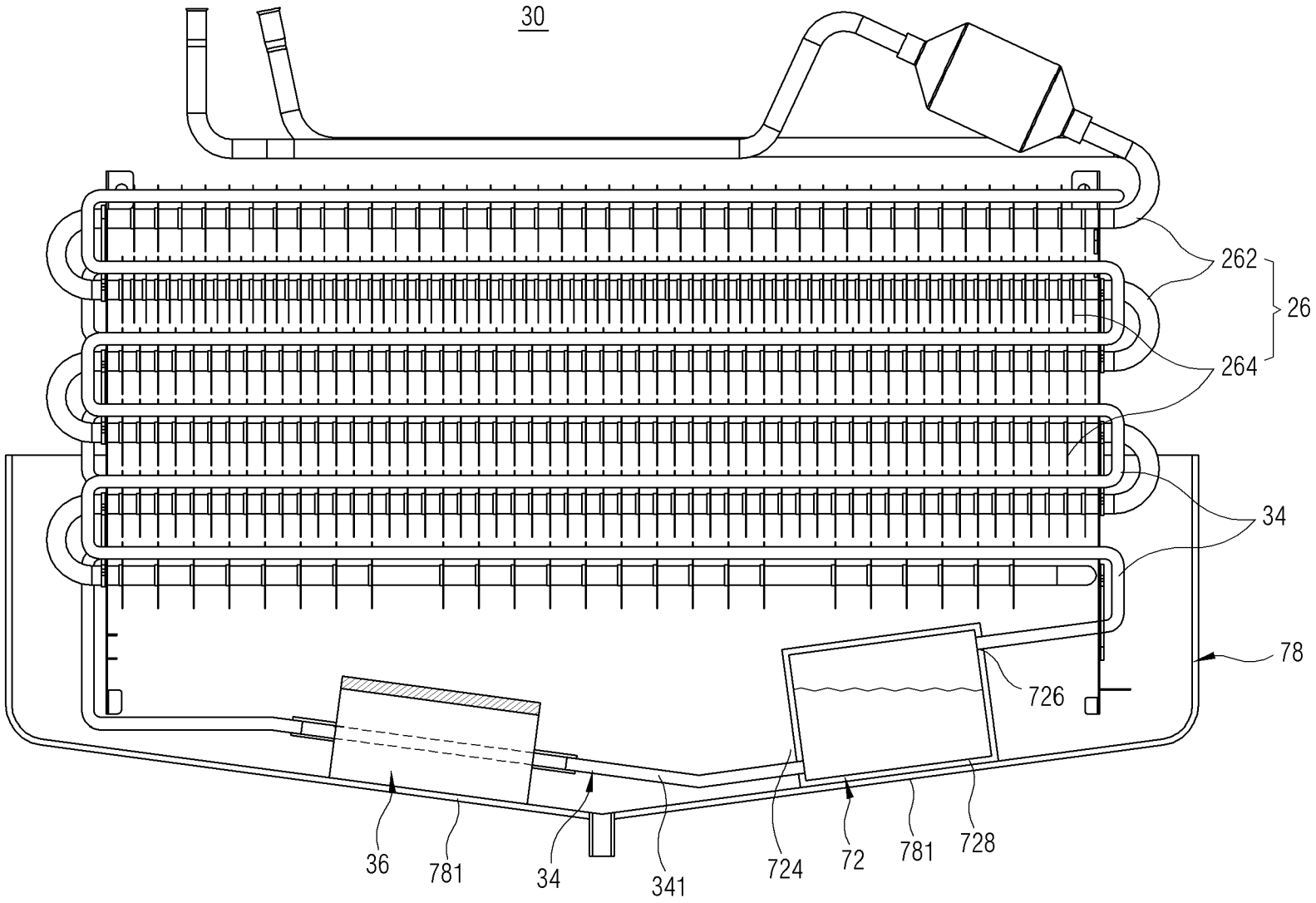
FIG. 15 illustrates a defroster installed in an evaporator according to a fourth embodiment of the disclosure.

FIG. 15 illustrates a defroster 30 installed in an evaporator 26 according to a fourth embodiment of the disclosure.

Referring to FIG. 15, the defroster 30 may include a fluid storage 72 in which working fluid is stored, a piping 34 in which the working fluid flows, a pumping part 36, and a drain plate 78.

The fluid storage 72 may be mounted onto an inclined first bottom portion 781 of the drain plate 78 as inclined.

Likewise, the pumping part 36 may be mounted onto the inclined first bottom portion 781 of the drain plate 78 as inclined.

Figure 16:
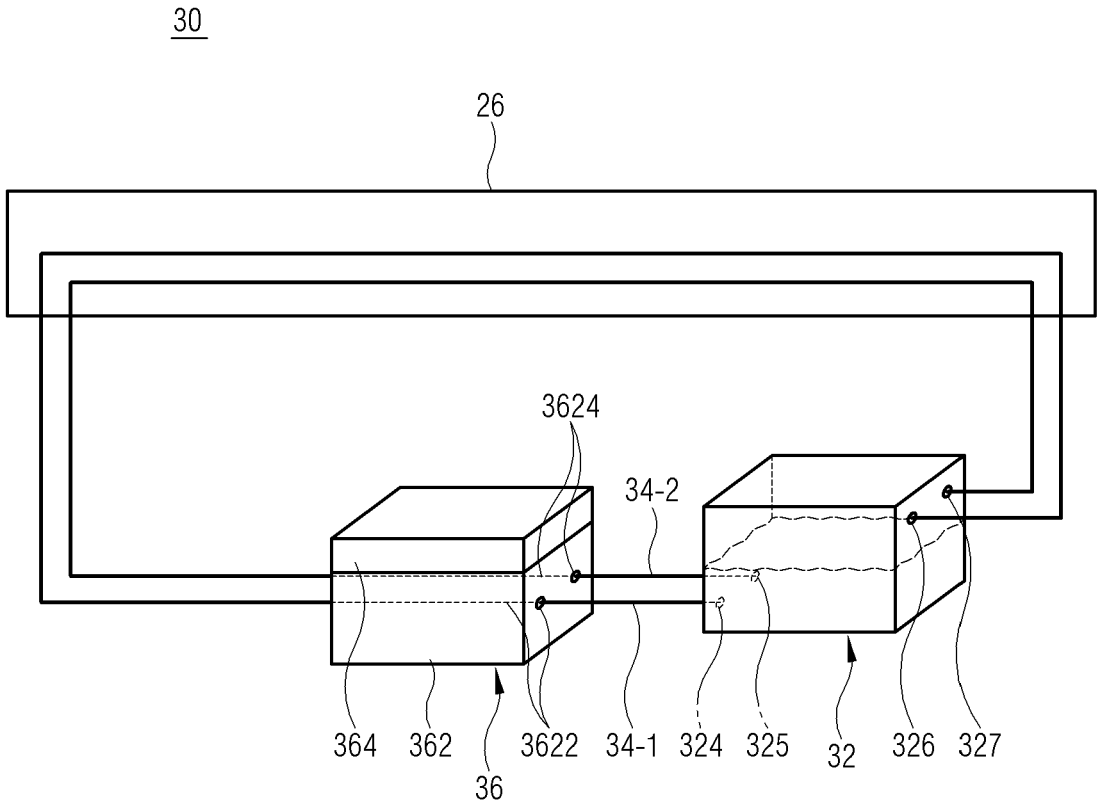
FIG. 16 illustrates a configuration of a defroster according to a fifth embodiment of the disclosure.

FIG. 16 illustrates a configuration of a defroster 30 according to a fifth embodiment of the disclosure. Below, the descriptions of the same or similar configurations according to the first embodiment shown in FIG. 11 will be omitted.

Referring to FIG. 16, the defroster 30 may include a first piping 34-1 and a second piping 34-2 in which working fluid flows.

The fluid storage 32 may include a first opening 324 and a third opening 325 through which working fluid goes out, and a second opening 326 and a fourth opening 327 through which the working fluid comes in.

The first piping 34-1 may include opposite ends respectively communicating with the first opening 324 of the fluid storage 32 and the second opening 326 positioned higher than the first opening 324. The first piping 34-1 may include a first circulation channel in which the working fluid flows between both ends thereof.

The first piping 34-1 may be extended from the first opening 324 of the fluid storage 32 along the refrigerant pipe 262 of the evaporator 26 via the pumping part 36 and connected to the second opening 326 of the fluid storage 32.

The second piping 34-2 may include opposite ends respectively communicating with the third opening 325 of the fluid storage 32 and the fourth opening 327 positioned higher than the third opening 325. The second piping 34-2 may include a second circulation channel in which the working fluid flows between both ends thereof.

The second piping 34-2 may be extended from the third opening 325 of the fluid storage 32 along the refrigerant pipe 262 of the evaporator 26 via the pumping part 36 and connected to the fourth opening 327 of the fluid storage 32.

The pumping part 36 may be provided at a certain position in the first and second circulation channels of the first and second pipings 34-1 and 34-2, and vaporize the working fluid, thereby circulating the working fluid in the first and second circulation channels.

The thermal conductive block 362 may include a first fluid passage 3622 through which the first piping 34-1 passes, and a second fluid passage 3624 through which the second piping 34-2 passes. The thermal conductive block 362 may use heat generated by the heater 364 to vaporize the working fluid flowing in the first and second pipings 34-1 and 34-2 passing therethrough.

The defroster 30 shown in FIG. 16 includes the first and second pipings 34-1 and 34-2 having the first and second circulation channels with respect to the fluid storage 32 and the pumping part 36, respectively, but may alternatively include three or more pipings.

As described above, the defroster 30 according to the fifth embodiment circulates the working fluid through the plurality of circulation channels, so that the whole channel length can be shortened or the pipings 34-1 and 34-2 can be more densely arranged in the evaporator 26, thereby improving a defrosting efficiency.

Figure 17:
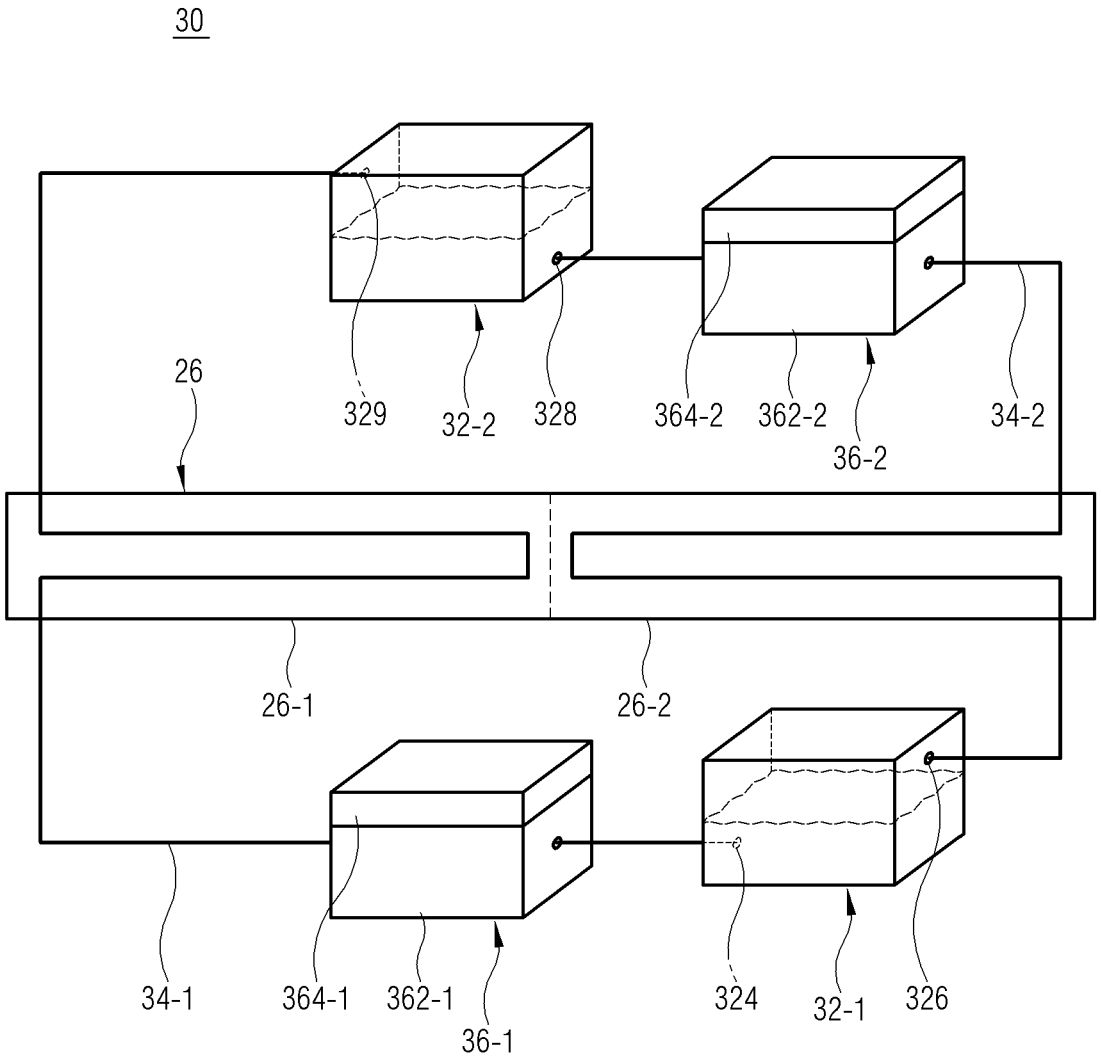
FIG. 17 illustrates a configuration of a defroster according to a sixth embodiment of the disclosure.

FIG. 17 illustrates a configuration of a defroster 30 according to a sixth embodiment of the disclosure.

Referring to FIG. 17, the defroster 30 may include first and second fluid storages 32-1 and 32-2 in which working fluid is stored, first and second pipings 34-1 and 34-2 in which the working fluid flows, and the first and second pumping parts 36-1 and 36-2.

The first fluid storage 32-1 may be filled with the working fluid at a certain level. The first fluid storage 32-1 may include a first opening 324 through which the working fluid goes out, and a second opening 326 through which the working fluid comes in. The first opening 324 may be positioned lower than the second opening 326. The first opening 324 may be positioned lower than the level of the working fluid, and the second opening 326 may be positioned higher than the level of the working fluid.

The second fluid storage 32-2 may be filled with the working fluid at a certain level. The second fluid storage 32-2 may include a fifth opening 328 through which the working fluid goes out, and a sixth opening 329 through which the working fluid comes in. The fifth opening 328 may be positioned lower than the sixth opening 329. The fifth opening 328 may be positioned lower than the level of the working fluid, and the sixth opening 329 may be positioned higher than the level of the working fluid.

The first piping 34-1 may form a first circulation channel connecting the first opening 324 of the first fluid storage 32-1, the first pumping part 36-1, and the sixth opening 329 of the second fluid storage 32-2. In this case, the first circulation channel between the first pumping part 36-1 and the second fluid storage 32-2 may go via a first area 26-1 of the evaporator 26 to thereby remove frost.

The second piping 34-2 may form a second circulation channel connecting the fifth opening 328 of the second fluid storage 32-2, the second pumping part 36-2, and the second opening 326 of the first fluid storage 32-1. The second circulation channel between the second pumping part 36-2 and the first fluid storage 32-1 may go via a second area 26-2 of the evaporator 26 to thereby remove frost.

FIG. 17 illustrates that the first fluid storage 32-1 and the first pumping part 36-1 are arranged below the evaporator 26, and the second fluid storage 32-2 and the second pumping part 36-2 are arranged above the evaporator 26, but the arrangement is not limited this illustration. For example, all the first fluid storage 32-1, the first pumping part 36-1, the second fluid storage 32-2, and the second pumping part 36-2 may be arranged above or below the evaporator 26.

The defroster 30 shown in FIG. 17 includes a first defrosting group including the first piping 34-1, the first fluid storage 32-1 and the first pumping part 36-1 to form the first circulation channel, and a second defrosting group including the second piping 34-2, the second fluid storage 32-2, and the second pumping part 36-2 to form the second circulation channel, but may alternatively include three or more defrosting groups.

As described above, the defroster 30 according to the sixth embodiment includes the plurality of defrosting groups in series on one wholly-connected circulation channel, thereby finishing the defrosting operation in a short period of time.

Figure 18:
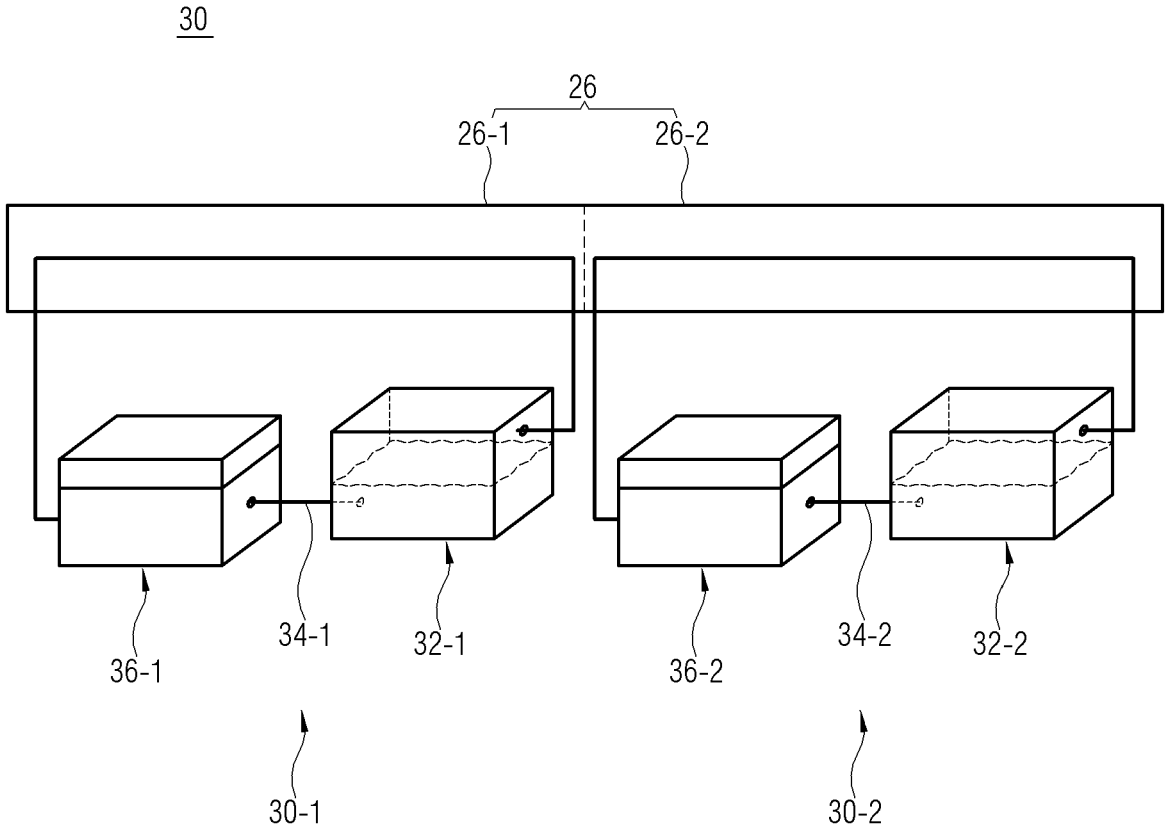
FIG. 18 illustrates a configuration of a defroster according to a seventh embodiment of the disclosure.

FIG. 18 illustrates a configuration of a defroster 30 according to a seventh embodiment of the disclosure.

Referring to FIG. 18, the defroster 30 may include a first defroster 30-1 which includes a first fluid storage 32-1 in which first working fluid is stored, a first piping 34-1 in which the first working fluid flows, and a first pumping part 36-1, and a second defroster 30-2 which includes a second fluid storage 32-2 in which second working fluid is stored, a second piping 34-2 in which second working fluid flows, and a second pumping part 36-2.

The first defroster 30-1 and the second defroster 30-2 may include circulation channels independently of each other, and respectively defrost the first area 26-1 and the second area 26-2 of the evaporator 26. Of course, the first defroster 30-1 and the second defroster 30-2 may remove frost from the first area 26-1 and the second area 26-2 in cooperation with each other.

Each of the first defroster 30-1 and the second defroster 30-2 has the same configurations and operations as the defroster 30 according to the first embodiment shown in FIG. 11, and thus repetitive descriptions thereof will be omitted.

The defroster 30 shown in FIG. 18 includes the first defroster 30-1 and the second defroster 30-2 which are independent of each other, but may alternatively include three or more defrosters which are independent of one another.

As described above, the defroster 30 according to the seventh embodiment includes the plurality of independent defrosters arranged in the evaporator 26 to thereby divisionally defrost the evaporator 26. For example, the frost may be focused in a lower portion of the evaporator 26, and thus the lower defrosters among the upper and lower independent defrosters may operate for a longer period of time or more frequently.

Figure 19:
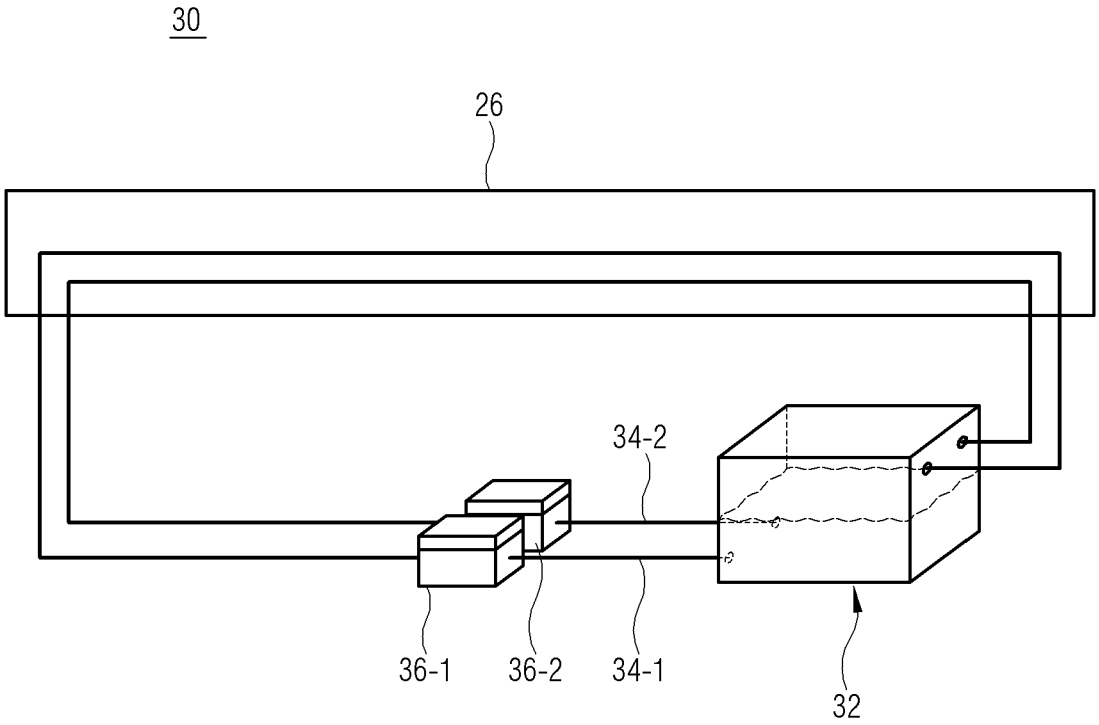
FIG. 19 illustrates a configuration of a defroster according to an eighth embodiment of the disclosure.

FIG. 19 illustrates a configuration of a defroster 30 according to an eighth embodiment of the disclosure.

Referring to FIG. 19, the defroster 30 may include a fluid storage 32 in which working fluid is stored, first and second pipings 34-1 and 34-2 in which the working fluid flows, and first and second pumping parts 36-1 and 36-2.

While the defroster 30 according to the second embodiment shown in FIG. 16 employs the single pumping part 36 to heat the working fluid in the first piping 34-1 and the second piping 34-2, the defroster 30 according to the eighth embodiment shown in FIG. 19 employs the first pumping part 36-1 and the second pumping part 36-2 to heat the working fluid in the first piping 34-1 and the second piping 34-2.

The defroster 30 according to the eighth embodiment includes the first and second pumping parts 36-1 and 36-2 respectively arranged in two pipings 34-1 and 34-2, but alternatively include three or more pumping parts respectively arranged in three or more pipings.

As described above, the defroster 30 according to the eighth embodiment sufficiently provides heat in a short period of time while the working fluid circulates in the plurality of pipes, thereby improving a defrosting efficiency.

Figure 20:
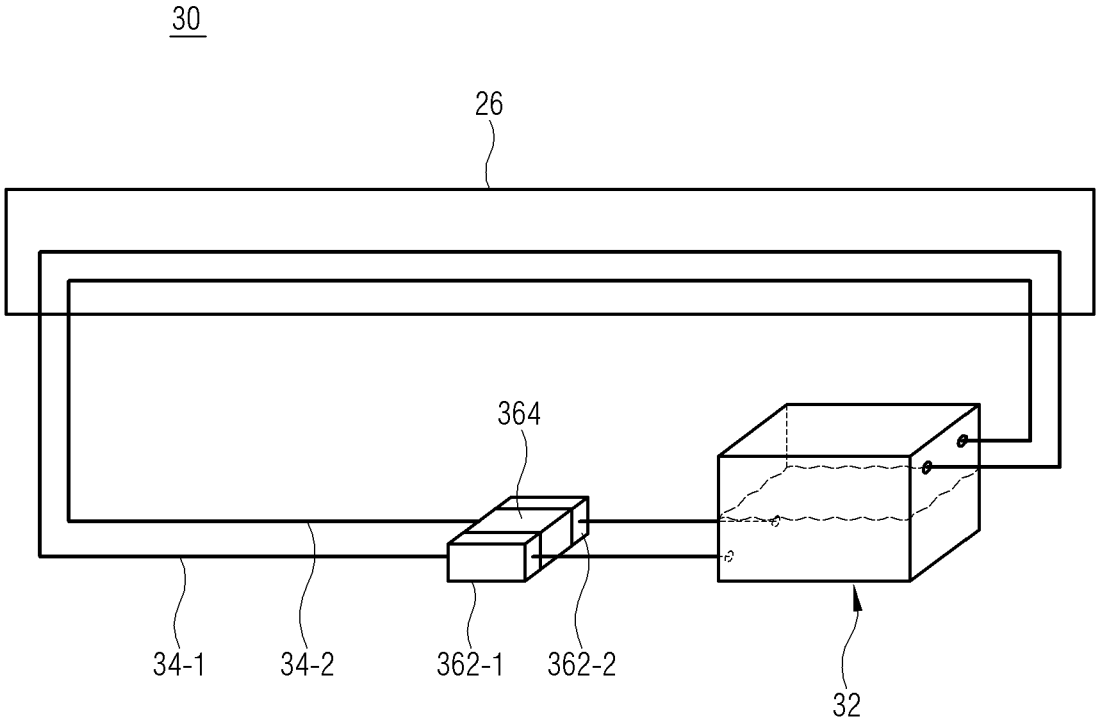
FIG. 20 illustrates a configuration of a defroster according to a ninth embodiment of the disclosure.

FIG. 20 illustrates a configuration of a defroster 30 according to a ninth embodiment of the disclosure.

Referring to FIG. 20, the defroster 30 may include a fluid storage 32 in which working fluid is stored, first and second pipings 34-1 and 34-2 in which the working fluid flows, and a pumping part 36.

In the defroster 30 according to the ninth embodiment, the pumping part 36 may include a first thermal conductive block 362-1, a second thermal conductive block 362-2, and a heater 364. In this case, the heater 364 may be interposed between the first thermal conductive block 362-1 and the second thermal conductive block 362-2.

Like this, the heater 364 is placed in between the first thermal conductive 362-1 and the second thermal conductive 362-2, thereby minimizing an outward heat release thereof.

As described above, the refrigerator according to the disclosure employs a heat-pumping type defroster to thereby defrost the evaporator at a higher efficiency than heat transfer of a conventional heater based on radiation and convection.

Although a few embodiments of the disclosure have been described in detail, various changes can be made in the disclosure without departing from the scope of claims.

What is claimed is:

1. A refrigerator comprising:
- a storage space;
- an evaporator configured to cool air in the storage space based on heat exchange of a refrigerant; and
- a defroster configured to remove frost formed on the evaporator, the defroster comprising:
  - a first pipe;
  - a second pipe extended around the evaporator, the first pipe and the second pipe forming a circulation channel through which working fluid circulates;
  - a fluid storage configured to store the working fluid, the fluid storage comprising:
    - a first opening to which the working fluid is discharged; and
    - a second opening into which the working fluid is introduced;
  - a pumping part disposed at a selected position on the circulation channel, the pumping part configured to vaporize the working fluid passing therethrough to circulate the vaporized working fluid in the circulation channel,
- wherein the pumping part comprising:
  - a thermal conductive block having:
    - a main body which is a solid;
    - a hollow formed in the main body, the hollow forms a flow channel that the working fluid passes through;
    - a first end of the hollow connected to the first pipe;
    - a second end of the hollow disposed in an opposite end to the first end, and connected to the second pipe; and
    - so that the working fluid passing through the flow channel is constricted while passing through the flow channel; and
    - a heater attached to the thermal conductive block, the heater configured to generate heat to heat the thermal conductive block so that the heated thermal conductive block vaporizes the working fluid passing through the flow channel, and
- wherein the first pipe is arranged apart from the evaporator, the first pipe comprises a first end connected with the first opening of the fluid storage and a second end connected with the first end of the thermal conductive block, and the second pipe connects the second opening of the fluid storage and the second end of the thermal conductive block.

2. The refrigerator according to claim 1, wherein
- the first opening of the fluid storage is positioned lower than the second opening of the fluid storage, and
- the selected position on the circulation channel is between the first opening of the fluid storage and the evaporator.

3. The refrigerator according to claim 2, wherein the pumping part is disposed closer to the first opening than the second opening.

4. The refrigerator according to claim 1, wherein a portion of the second pipe around the evaporator is disposed at a higher position than a position of the fluid storage.

5. The refrigerator according to claim 1, wherein the first opening is disposed lower than a level of the working fluid stored in the fluid storage, and the second opening is disposed higher than the level of the working fluid stored in the fluid storage.

6. The refrigerator according to claim 1, wherein the thermal conductive block comprises at least one of aluminum, copper or iron.

7. The refrigerator according to claim 1, wherein the defroster further comprises a drain plate disposed below the evaporator and configured to collect defrosted water from the frost melted by the vaporized working fluid.

8. The refrigerator according to claim 7, wherein at least one of the thermal conductive block or the fluid storage is in contact with the drain plate.

9. The refrigerator according to claim 1, wherein the pumping part further comprises a first pipe connector and a second pipe connector respectively formed in the first end of the thermal conductive block and the second end of the thermal conductive block, and the first pipe connector and the second pipe connector configured to connect the flow channel of the thermal conductive block with the first pipe and the second pipe, respectively.

10. The refrigerator according to claim 9, wherein the first pipe connector and the second pipe connector comprises a lower thermal-conductivity material than a material of the second pipe.

11. The refrigerator according to claim 9, wherein
- each of the first pipe connector and the second pipe connector comprises a first material,
- the second pipe comprises a second material, and thermal conductivity of the first material is higher than thermal conductivity of the second material.

12. The refrigerator according to claim 1, further comprising a plurality of pipe structures respectively includes the first pipe and the second pipe, and wherein the circulation channel is a first circulation channel, the first pipe structure including the first circulation channel, and the defroster further comprises a second pipe structure having at least one second pipe thereof extended around the evaporator and comprising a second circulation channel which the working fluid circulates.

13. The refrigerator according to claim 1, wherein the hollow is the first hollow and the flow channel is a first flow channel and the thermal conductive block further comprises a second which forms a second flow channel through which the working fluid from the second pipe passes.

14. The refrigerator according to claim 1, wherein
- the fluid storage is a first fluid storage configured to store a first working fluid,
- the first pipe is extended around a first area of the evaporator, the pumping part is a first pumping part disposed on a first circulation channel between the first area of the evaporator and the first fluid storage, and the defroster further comprises:

the second pipe extended around a second area of the evaporator, and comprising a second circulation channel in which a second working fluid circulates;

a second fluid storage comprising a third opening and a fourth opening respectively communicating with opposite end portions of the second pipe, and configured to store second working fluid; and a second pumping part disposed at a selected position on the second circulation channel of the second pipe between the second area of the evaporator and the second fluid storage, and configured to vaporize the second working fluid to circulate the vaporized second working fluid in the second circulation channel.

15. The refrigerator according to claim 14, wherein the first pumping part comprises a first thermal conductive part comprising a first fluid passage through which working fluid of the first pipe passes, the second pumping part comprises a second thermal conductive part comprising a second fluid passage through which working fluid of the second pipe passes, and the defroster further comprises a heater interposed between the first thermal conductive part and the second thermal conductive part.

16. The refrigerator according to claim 1, wherein the pumping part is a first pumping part, the fluid storage further comprises a third opening and a fourth opening, and the defroster further comprises:

the second pipe extended around the evaporator, and comprising:

opposite end portions respectively communicating with the third opening and the fourth opening of the fluid storage; and a second circulation channel in which the working fluid flows between the opposite end portions; and a second pumping part disposed at a selected position on the second circulation channel of the second pipe between the evaporator and the fluid storage, and configured to vaporize the working fluid to circulate the vaporized working fluid in the second circulation channel.

17. The refrigerator according to claim 1, wherein the pumping part is configured to move the vaporized working fluid along a circulation channel in a direction away from the fluid storage.

18. The refrigerator according to claim 1, wherein the pumping part is configured to pump the working fluid based on expansion and contraction of the working fluid.

19. A refrigerator comprising:

a storage space;

an evaporator configured to cool air in the storage space based on heat exchange of a refrigerant; and a defroster configured to remove frost formed on the evaporator, the defroster comprising:

a pipe extended around the evaporator and comprising a circulation channel through which working fluid circulates;

a fluid storage comprising a first opening and a second opening respectively communicating with opposite end portions of the pipe, and configured to store the working fluid;

a pumping part disposed at a selected position on the circulation channel of the pipe between the evaporator and the fluid storage, and configured to vaporize the working fluid to circulate the vaporized working fluid in the circulation channel, the pumping part comprising:

a thermal conductive part comprising a fluid passage through which the working fluid passes; and a heater configured to generate heat to vaporize the working fluid in the pumping part, wherein the pipe is a first pipe extended around a first area of the evaporator, and the defroster further comprises a second pipe extended around a second area of the evaporator, the fluid storage is a first fluid storage disposed on a circulation channel between a first end portion of the first pipe and a first end portion of the second pipe, the pumping part is a first pumping part disposed on a circulation channel between the first area and the first opening of the first fluid storage, and the defroster comprises:

a second fluid storage disposed on a circulation channel between a second end portion of the first pipe and a second end portion of the second pipe, and configured to store the working fluid; and a second pumping part disposed on the circulation channel of the second pipe part between the second fluid storage and the second area.

* * * * *